US006293768B1

(12) United States Patent
Shintoku et al.

(10) Patent No.: US 6,293,768 B1
(45) Date of Patent: Sep. 25, 2001

(54) PISTON TYPE COMPRESSOR

(75) Inventors: Noriyuki Shintoku; Hisato Kawamura; Motonobu Kawakami, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/544,081

(22) Filed: Apr. 6, 2000

(30) Foreign Application Priority Data

May 11, 1999 (JP) ..... 11-129797

(51) Int. Cl.[7] ..... F04B 39/00; F04B 53/00
(52) U.S. Cl. ..... 417/312; 92/71; 417/269
(58) Field of Search ..... 417/269, 312, 417/540, 222.1; 92/71

(56) References Cited

U.S. PATENT DOCUMENTS 4,836,754 * 6/1989 Ikeda et al. ..... 417/269
5,518,374 * 5/1996 Ota et al. ..... 417/222.1
5,603,611 * 2/1997 Tarutani et al. ..... 417/269
5,702,236 * 12/1997 Ikeda et al. ..... 92/71
5,842,836 * 12/1998 Tarutani et al. ..... 417/269
5,899,670 * 5/1999 Ikeda et al. ..... 417/312
6,045,342 * 4/2000 Kimura ..... 417/540
6,068,453 * 5/2000 Ahn et al. ..... 417/269
6,077,049 * 6/2000 Nakamura et al. ..... 417/269

FOREIGN PATENT DOCUMENTS

07286579 * 1/1995 (JP) .
8-261147 10/1996 (JP) .

* cited by examiner

*Primary Examiner*—Teresa Walberg
*Assistant Examiner*—Leonid M. Fastovsky
(74) *Attorney, Agent, or Firm*—Morgan & Finnegan, LLP

(57) ABSTRACT

In a piston type compressor according to the present invention, a center muffler chamber 39 is defined in a retaining portion 37 inside a discharge chamber on the rear side. The discharge chamber 27 on the rear side is communicated with the center muffler chamber 39 through a communication hole 40 bored in the retaining portion 37. In the discharge chamber 27 on the rear side, therefore, a flow passage of a discharge refrigerant gas flowing through the communication hole 40 and the center muffler chamber 39 is so defined as to extend from each port 32*b* to an external refrigerating circuit.

7 Claims, 7 Drawing Sheets

PISTON TYPE COMPRESSOR

BACKGROUND OF THE INVENTION

1. Field of the Invention

This invention relates to a piston type compressor that is used for a car air conditioner, for example, and compresses a refrigerant gas by the reciprocating motion of pistons.

2. Description of the Related Art

A double-headed piston-type compressor shown in FIGS. 6 and 7 of the accompanying drawings is known as a compressor of this kind.

A pair of cylinder blocks 101 and 102 are mutually joined and fixed at their opposed end portions as shown in FIG. 6. A front housing 103 is joined and fixed to the end portion of the cylinder block 101 on the front side (on the left side in the drawing). A rear housing 104 is joined and fixed to the end portion of the cylinder block 102 on the rear side (on the right side in the drawing). A drive shaft 105 is rotatably supported in such a fashion as to extend from the cylinder blocks 101 and 102 to the front housing 103. A plurality of cylinder bores 106 are formed round the axis L of the drive shaft 105 in each cylinder block 101, 102. A double-headed-type piston 107 is accommodated in each cylinder bore 106 and is connected to the drive shaft 105 through a swash plate 108.

A suction chamber 109 is defined on the outer peripheral side of each of the housings 103 and 104 as shown in FIG. 7. A discharge chamber 110 is defined on the inner peripheral side of the suction chamber 109 in each of the housings 103 and 104. Though FIG. 7 shows the rear housing (104) side, the construction is substantially similar on the front housing (103) side, too.

Turning back again to FIG. 6, a valve/port-forming member 111 is clamped between each of the cylinder blocks 101, 102 and each of the housings 103, 104. The valve/port-forming member 111 has a suction port 112 and a suction valve 113 that are interposed between each cylinder bore 106 and the suction chamber 109, and a discharge port 114 and a discharge valve 115 that are interposed between each cylinder bore 106 and a discharge chamber 110, respectively. A plurality of discharge valves 115 are so formed as to extend in a radial direction (in the direction of the corresponding discharge port 114) from the outer edge portion of a disc-like substrate 116 (see FIG. 7).

The rotational motion of the drive shaft 105 is converted to the reciprocating motion of the piston 107 through the swash plate 108. In consequence, a series of compression cycles of suction of the refrigerant gas of the suction chamber 109 into the cylinder bores 106 through the suction port 112 and the suction valve 113, compression of the refrigerant gas that is sucked, and discharge of the compressed refrigerant gas to the discharge chamber 110 through the discharge port 114 and the discharge valve 115 are repeatedly carried out. The refrigerant gas discharged to the discharge chamber 110 is exhausted to an external refrigerating circuit.

Inside each housing 103, 104, the retaining portion 117 comprises a ring-like wall body, as shown in FIG. 7, and is formed in such a fashion as to extend into the discharge chamber 110. The retaining portion 117 retains a ring-like area in the center portion of the valve/port-forming member 111 by its distal end surface 117*a* (FIG. 6). The valve/port-forming member 111 comprises a laminate of a plurality of sheet materials, and its outer peripheral side is clamped directly by the cylinder block 101, 102 and the housing 103, 104. If this retaining portion 117 is not disposed, the center portion of the valve/port-forming member 111, that corresponds to a large space (discharge chamber 110) in a direction orthogonal to the axis L of the drive shaft 105, cannot be directly clamped by the cylinder block 101, 102 and the housing 103, 104. In consequence, each sheet-like member is likely to float up on the center side. Particularly because the substrate 116, that functions as the base portion for allowing the discharge valve 115 to undergo deformation as a reed valve, cannot be retained under a suitable condition inside the valve/port-forming body 111, deformation of the discharge valve 115 does not occur in a stable way.

The piston type compressor having the construction described above is not free from the problem of vibration and noise that occur in the piping arrangement of the external refrigerating circuit due to pressure pulsation of the discharge refrigerant gas. A muffler chamber 118 is formed in an outer profile portion of the cylinder block 101, 102 to solve this problem. The discharge refrigerant gases from the front and rear side discharge chambers 110 join each other in the muffler chamber 118. The muffler chamber 118 exhibits its muffler function to damp the pressure pulsation and then discharges the gas to the external refrigerating circuit. To improve the effect of damping the pressure pulsation of the discharge refrigerant gas, the capacity of the muffler chamber 118 must be increased, resulting in an increase in the size of the compressor.

Considering specifically the retaining portion 117 of the rear housing 104, a space 119 exists inside the retaining portion 117. To reduce an increase in the weight of the compressor, this space 119 is formed as the retaining portion 117 and is shaped in the ring-like form to correspond to only the outer peripheral portion of the substrate 116. In other words, as the necessity for providing the retaining portion 117 is not very high, the space 119 is formed on the rear housing 104 and the space 119 is a dead space that uselessly occupies the inside of the retaining portion 117.

SUMMARY OF THE INVENTION

It is an object of the present invention to provide a piston type compressor that can reduce pressure pulsations in a discharge refrigerant gas without increasing its size by utilizing an internal space of a retaining portion of a rear housing as a muffler chamber.

To accomplish the object described above, the present invention provides a piston type compressor that includes a cylinder block; a front housing joined and fixed to an end portion of the cylinder block on the front side; a rear housing joined and fixed to an end portion of the cylinder block on the rear side; a drive shaft rotatably disposed as to extend from the cylinder block to the front housing; a plurality of cylinder bores formed round the drive shaft in the cylinder block; a piston accommodated in each cylinder bore and caused to reciprocate by the revolution of the drive shaft; a suction chamber defined inside, and on the peripheral side of, the rear housing; a valve/port-forming member equipped with a suction port and a suction valve that are clamped between the cylinder block and the rear housing and are disposed between each cylinder bore and the suction chamber, and with a discharge port and a discharge valve that are disposed between each cylinder bore and a discharge chamber; and a retaining portion so formed in the rear housing as to extend into the discharge chamber, and retaining the valve/port-forming member by its distal end face and by the cylinder block; wherein a center muffler chamber is defined inside the retaining portion and a discharge gas from the discharge chamber flows to an external circuit through the center muffler chamber.

In this construction, the piston is caused to reciprocate when the drive shaft rotates, and a series of compression cycles of suction of the gas of the suction chamber into the cylinder bore through the suction port and the suction valve, compression of the suction gas, and discharge of the compressed gas to the discharge chamber through the discharge port and the discharge valve are conducted.

The gas discharged from each discharge port to the discharge chamber flows through the center muffler chamber. The muffler operation of this center muffler chamber reduces the pressure pulsations, and the gas is discharged to the external circuit. The center muffler chamber is defined by effectively utilizing the inside of the retaining portion, that was dead space in the prior art compressors, and does not call for an increase of the size of the compressor to reduce the pressure pulsations in the discharge gas.

The present invention may be understood more fully from the description of preferred embodiments of the invention set forth below, together with the accompanying drawings.

DESCRIPTION OF THE PREFERRED EMBODIMENTS

Hereinafter, an embodiment of the present invention that is applied to a double head piston type compressor used for an air conditioner of a car will be explained.

Figure 1:
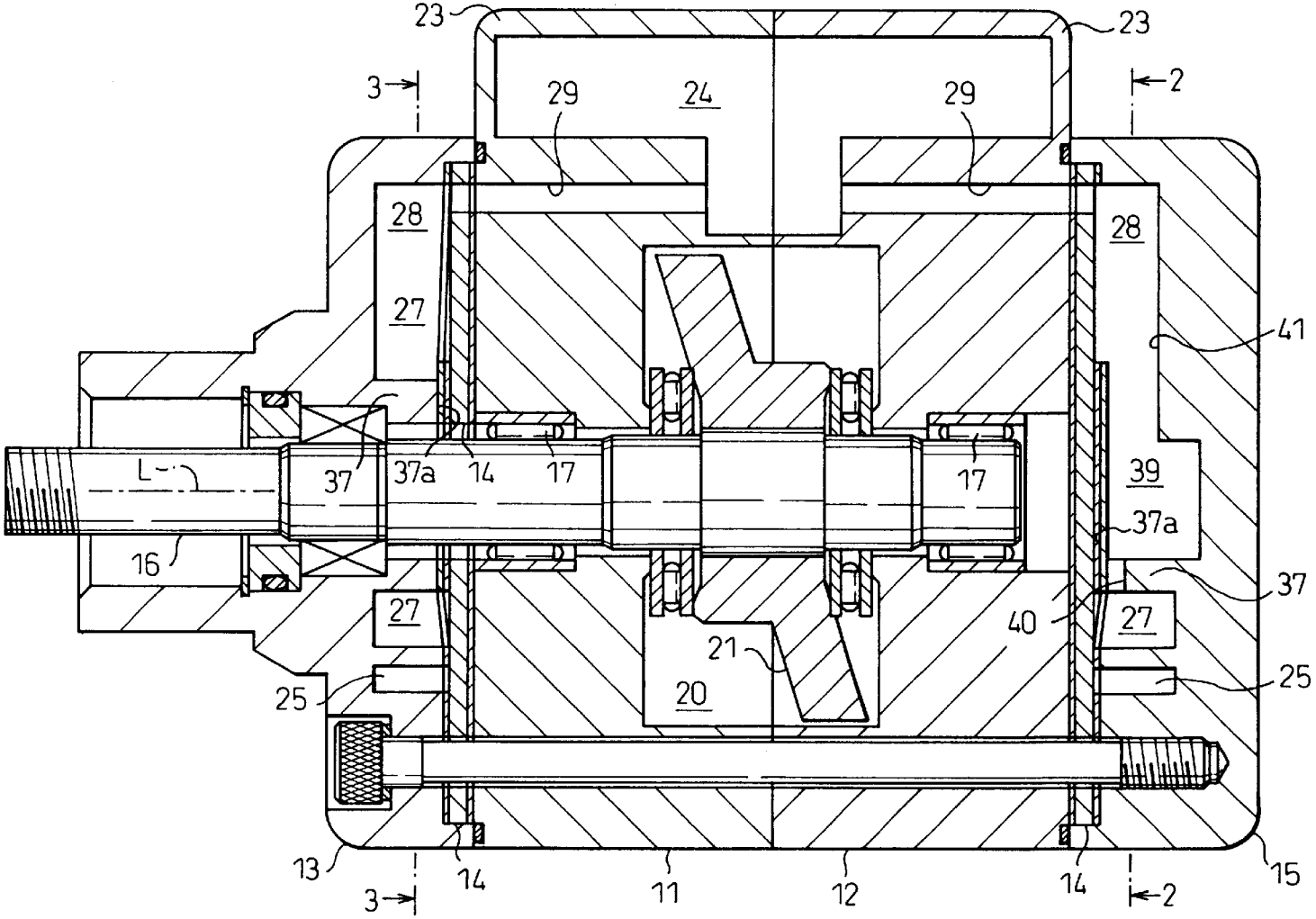
FIG. 1 is a sectional view taken along a line 1—1 of FIG. 2, and is a longitudinal sectional view of a double head piston type compressor according to the present invention.
Figure 4:
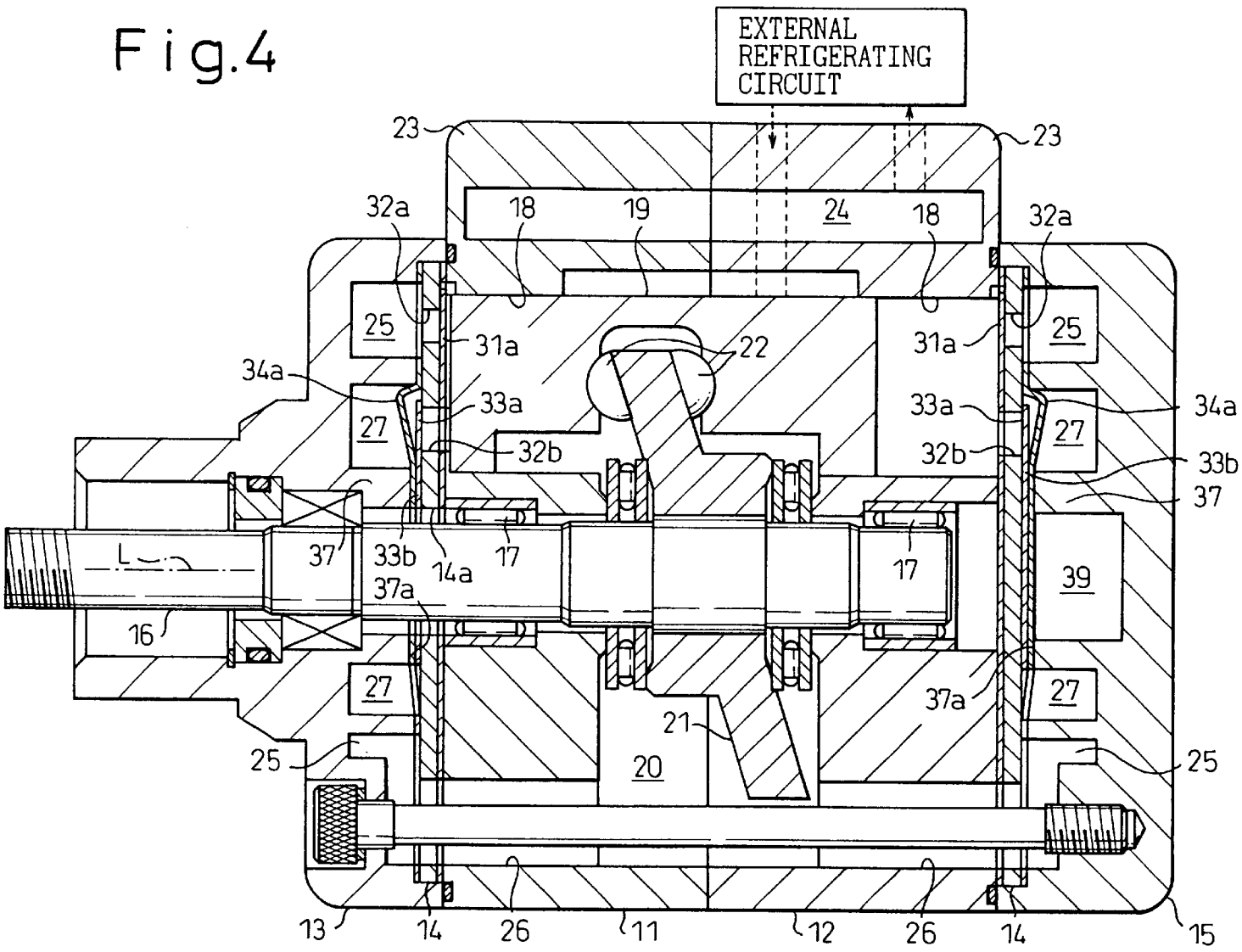
FIG. 4 is a sectional view taken along a line 4—4 of FIG. 2.

A pair of cylinder blocks 11 and 12 are joined and fixed to each other at their opposed end faces as shown in FIGS. 1 and 4. A front housing 13 is joined and fixed to the end portion of the cylinder block 11 on the front side (on the left side in the drawings) through a valve/port-forming member 14. A rear housing 15 is joined and fixed to the end portion of the cylinder block 12 on the rear side (on the right side in the drawings) through a valve/port-forming member 14.

A drive shaft 16 is supported turnably at the center of the cylinder blocks 11 and 12 through a pair of front and rear radial bearings 17. The front side of the drive shaft 16 protrudes outside while penetrating through the center portion of the front housing 13. The drive shaft 16 is connected operatively to an external driving source such as a car engine, not shown, and is driven for rotation by this external drive source.

A plurality of cylinder bores 18 (five bores in this embodiment, though not shown in the drawings) are formed between both end portions of each cylinder block 11, 12 on the same circumference with a predetermined distance between them in such a manner as to extend in parallel with an axis L of the drive shaft 16. A plurality of double-headed pistons (five pistons in this embodiment, though not shown in the drawings) are fitted into, and supported by, these cylinder bores 18 and are allowed to reciprocate inside them. The front and rear end faces of each piston 19 and each valve/port-forming member 14 define a space for compressing a refrigerant gas inside each cylinder bore 18.

A crank chamber 20 is defined at an intermediate portion between and inside both cylinder blocks 11 and 12. A swash plate 21 is fitted and fixed to the drive shaft 16 inside the crank chamber 20. The piston 19 is anchored to the outer peripheral portion of the swash plate 21 through a shoe 22. The rotational motion of the drive shaft 16 is converted to the reciprocating motion of the piston 19 through the swash plate 21 and the shoe 22.

A muffler portion 23 is formed on the outer profile portion of each cylinder block 11, 12 in such a manner as to protrude from the cylinder block. The internal space of both muffler portions 23 is open to face the opposed muffler portion 23. The internal space of both muffler portions 23 is integrated as both cylinder blocks 11 and 12 are joined to fixed to each other, and defines a muffler chamber 24 bridging between both muffler portions 23.

A suction chamber 25 is defined into a ring-like shape inside and on the outer peripheral side of each housing 13, 15. Each suction chamber 25 is communicated with the crank chamber 20 through a suction passage 26. A discharge chamber 27 is formed on the inner peripheral side of the suction chamber 25 inside each housing 13, 15. A part of the discharge chamber 27 is extended to the outer peripheral side of each housing 13, 15 in such a manner as to cut the ring-like shape of the suction chamber 25. This extension portion defines a communication chamber 28. The communication chamber 28 is communicated with a main muffler chamber 24 through a discharge passage 29. In other words, the flow passages of the refrigerant gas of the discharge chambers 27 on the front and rear sides join together in the main muffler chamber 24. The crank chamber 20 and the main muffler chamber 24 are connected by an external refrigerating circuit (see FIG. 4) equipped with a condenser, an expansion valve and an evaporator. The external refrigerating circuit and the compressor together constitute a refrigeration circuit of a car air conditioner.

Figure 5:
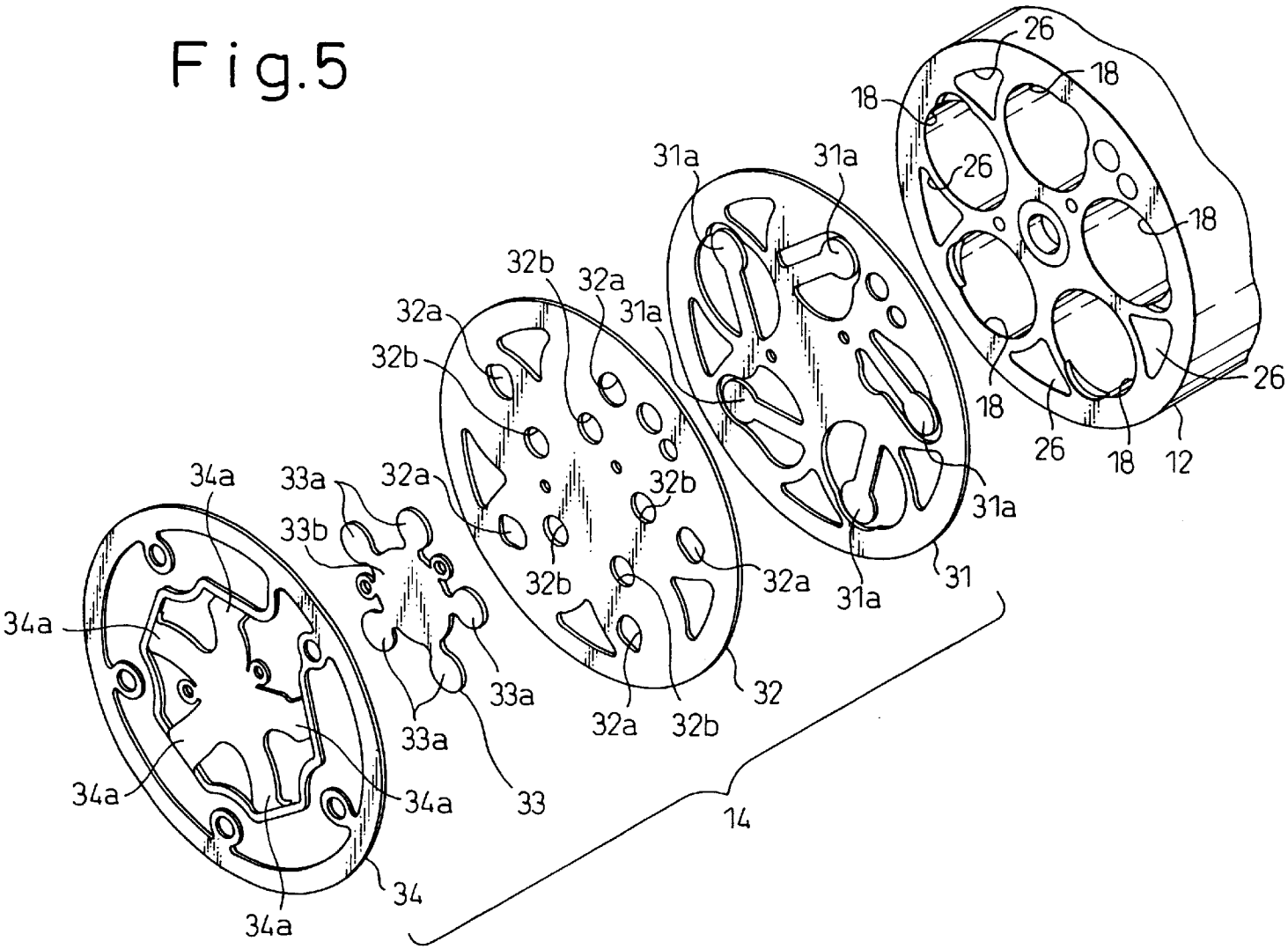
FIG. 5 is an exploded perspective view of a valve/port-forming member.

The valve/port-forming member 14 comprises a suction valve forming plate 31, a port forming plate 32, a discharge valve forming plate 33 and a retainer forming plate 34 that are laminated, in order, from the side of the cylinder blocks 11 and 12 to the side of the housings 13 and 15, as shown in FIG. 5. Incidentally, though FIG. 5 shows the valve/port-forming member 14 on the rear side, the valve/port-forming member 14 on the front side has the same construction with the exception of a construction for allowing the insertion of the drive shaft 16 (insertion holes 14*a* (see FIG. 1)) at the center.

A plurality of suction ports 32*a* are bored on the outer peripheral side of the port forming plate 32, and communicate each cylinder bore 18 and the suction chamber 25. A plurality of suction valves 31*a*, each comprising a reed valve, are formed in the suction valve forming plate 31 and can open and close the corresponding suction ports 32*a*. A plurality of discharge ports 32*b* are bored on the inner peripheral side of the port forming plate 32 and communicate each cylinder bore 18 with the discharge chamber 27. A plurality of discharge valves 33*a*, each comprising a reed valve, are formed in the discharge valve forming plate 33 and can open and close the corresponding discharge ports 32*b*.

The discharge valve forming plate 33 comprises a disc-like substrate 33*b* and a plurality of discharge valves 33*a* extending from the outer edge portion of the substrate 33*b* in the radiating direction (towards the corresponding discharge ports 32*b*). When the cylinder blocks 11 and 12 and the housings 13 and 15 are joined, the substrate 33*b* of the discharge valve forming plate 33, that functions as the base portion for allowing each discharge valve 33*a* to undergo deformation as a reed valve, is clamped between the port forming plate 32 and the retainer forming plate 34. As a result, each discharge valve 33*a* is provided with the deformation function. A plurality of retainers 34*a* are formed on the retainer-forming plate 34 and define the maximum opening of the discharge valve 33*a*.

Next, the operation of the piston type compressor having the construction described above will be explained.

When each piston 19 is allowed to reciprocate with the revolution of the drive shaft 16, a series of compression cycles of suction of the refrigerant gas of the suction chamber 25 into each cylinder bore 18 through the suction port 32*a* and through the suction valve 31*a*, compression of the refrigerant gas so sucked, and discharge of the compressed refrigerant gas into the discharge chamber 27 through the discharge port 32*b* and through the discharge valve 33*a*, are repeated.

The discharge refrigerant gases discharged into the discharge chambers 27 on the front and rear sides, respectively, join each other in the main muffler chamber 24 through the communication chamber 28 and through the discharge passage 29. After pressure pulsation is damped by the expansion type muffler operation in the main muffler chamber 24, the joining discharge refrigerant gas is discharged into the external refrigerating circuit. Therefore, the vibration and the noise occurring in the piping arrangement of the external refrigerating circuit due to the pressure pulsation of the discharge refrigerant gas can be reduced.

Next, the features of this embodiment will be explained in detail.

The retaining portion 37 comprises a disc-like wall body having its center positioned at the axis L of the drive shaft 16 as shown in FIGS. 1 to 4. The retaining portion 37 extends integrally from the inner wall surface of the discharge chamber 27 towards the valve/port-forming member 14 inside each housing 13, 15. The retaining portion 37 is pushed at its distal end face 37*a* to the center portion of the valve/port-forming member 14 (retainer forming plate 34) in the ring-like region having its center positioned on the axis L. The retaining portion 37 clamps the center portion of the valve/port-forming member 14 in cooperation with the cylinder blocks 11 and 12. The outer diameter of the retaining portion 37 is somewhat smaller than the outer diameter of the substrate 33*b* of the discharge valve forming plate 33. Therefore, the outer peripheral portion of the substrate 33*b* of the discharge valve forming plate 33 is firmly clamped between the port forming plate 32 and the retainer forming plate 34 inside the valve/port-forming member 14. Consequently, each discharge valve 33*a* can stably exhibit its deformation function as a reed valve.

The retaining portion 37 formed in the front housing 13 allows the drive shaft 16 to be inserted into the front housing 13, and functions also as a dividing wall, that cuts off the discharge chamber 27 on the front side from the drive shaft 16, in addition to its function of retaining the center portion of the valve/port-forming member 14.

Figure 3:
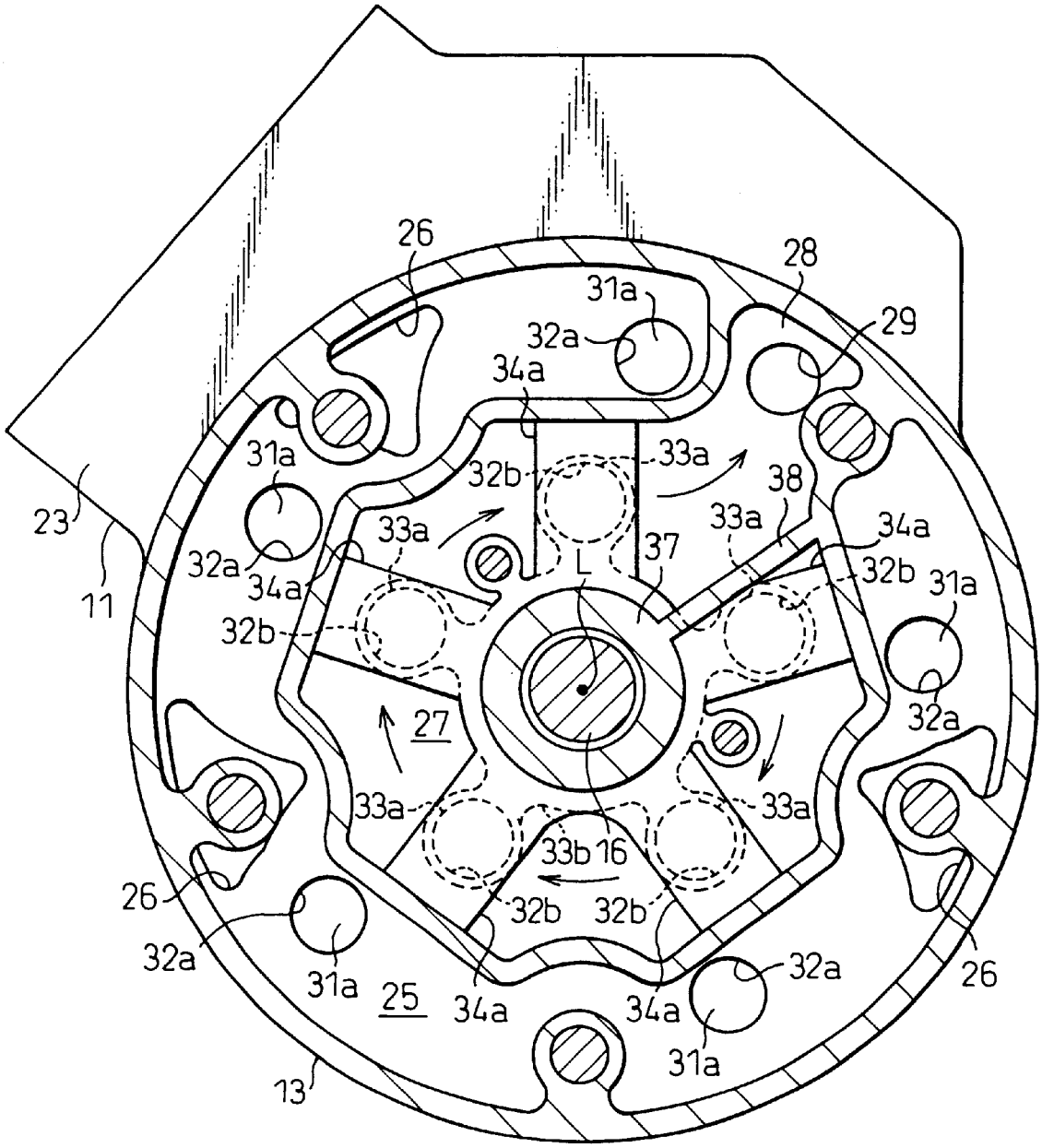
FIG. 3 is a sectional view taken along a line 3—3 of FIG. 1.

A partition wall 38 is formed in the front housing 13 as shown in FIG. 3, and partitions the discharge chamber 27 in such a manner as to cut off the ring-shape around the retaining portion 37. The partition wall 38 is so disposed as to cut off two discharge ports 32*b* adjacent to each other in the proximity of the communication chamber 28. Therefore, the discharge port 32*b* on the opposite side to the communication chamber 28 (on the right side of the drawing) of these two discharge ports 32*b* has the greatest communication distance from the communication chamber 28 among a plurality (five) of the discharge ports 32*b*. In other words, a flow passage of the discharge refrigerant gas extending clock-wise a round the retaining portion 37 is defined from each discharge port 32*b* to the communication chamber 28 inside the discharge chamber 27 on the front side.

Figure 2:
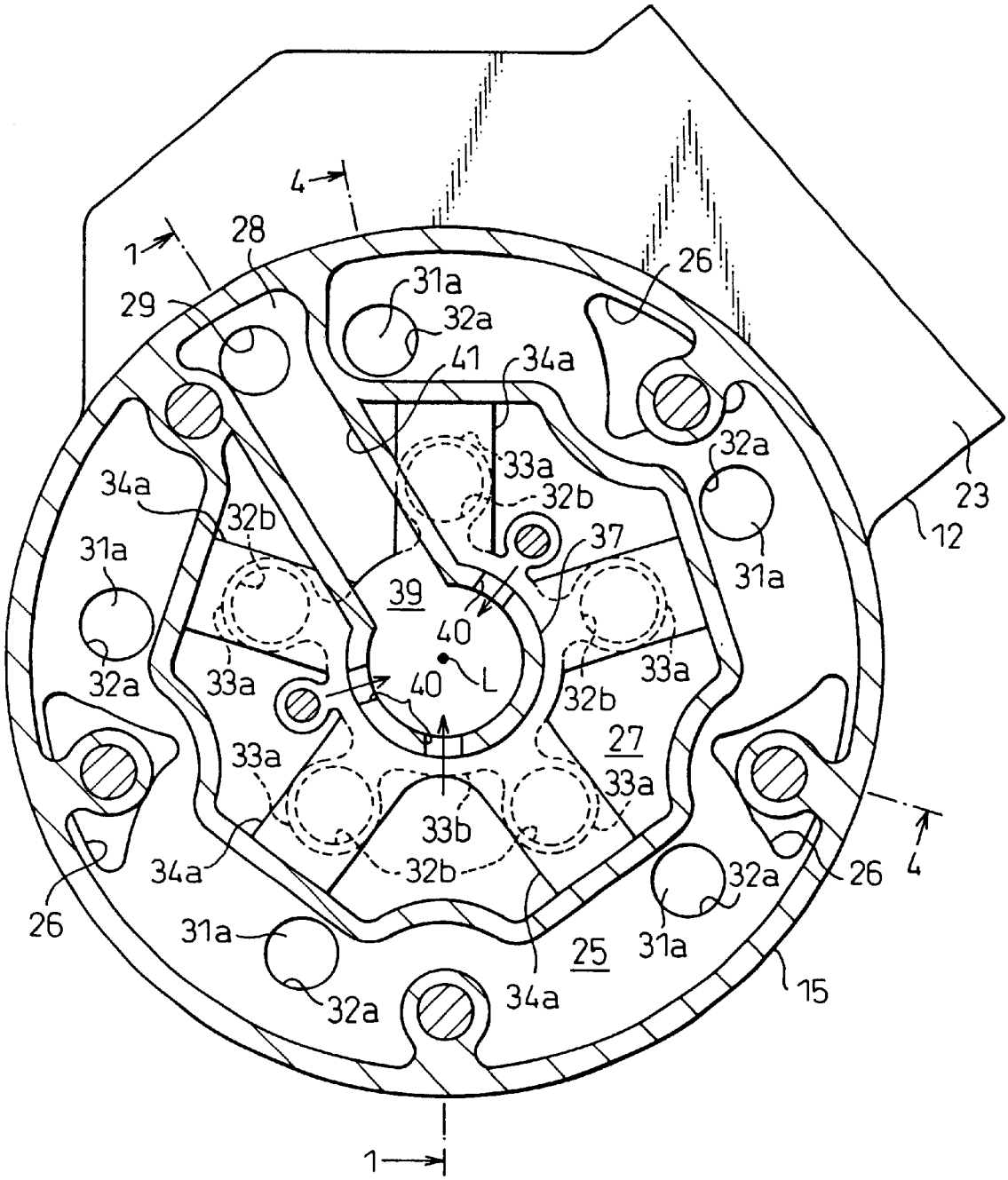
FIG. 2 is a sectional view taken along a line 2—2 of FIG. 1.

A space 39 is defined in the retaining portion 37 inside the discharge chamber 27 on the rear side as shown in FIG. 2. One of the objects of this space 39 is to reduce an increase of the weight of the compressor. The space 39 is formed by shaping the retaining portion 37 into the ring-like shape that corresponds only to the outer peripheral portion of the substrate 33*b*. In other words, the thickness of the retaining portion 37 corresponding to the inner peripheral portion of the substrate 33*b*, at which the retaining property is not strongly required, is decreased. This space functions as a center muffler chamber 39 in this embodiment.

A plurality (three) of communication holes 40 are so formed as to cut out partially the ring-like shape of the distal end face 37*a* at the distal end of the retaining portion 37 on the rear side. The discharge chamber 27 on the rear side is communicated with the center muffler chamber 39 through these communication holes 40. A communication passage 41 is formed in such a manner as to cross transversely the discharge chamber 27 inside the rear housing 15, and communicates the center muffler chamber 39 with the communication chamber 28. In consequence, a flow passage of the discharge refrigerant gas, that ranges from each port 32*b* to the communication chamber 28 through the communication chamber 40, the center muffler chamber 39 and the communication passage 41 in this order, is formed inside the discharge chamber 27 on the rear side.

The refrigerant gas discharged from each discharge port 32*b* on the front side to the discharge chamber 27 is caused to flow clock-wise around the retaining portion 37 as indicated by arrows in FIG. 3 and then flows into the main muffler chamber 24 through the communication chamber 28 and through the discharge passage 29. Because fluidization of the discharge refrigerant gas is limited in this way to one direction inside the discharge chamber 27 on the front side, pressure pulsation of the discharge refrigerant gas from the front side is decreased to a certain extent before the discharge refrigerant gas flows into the main muffler chamber 24.

Figure 6:
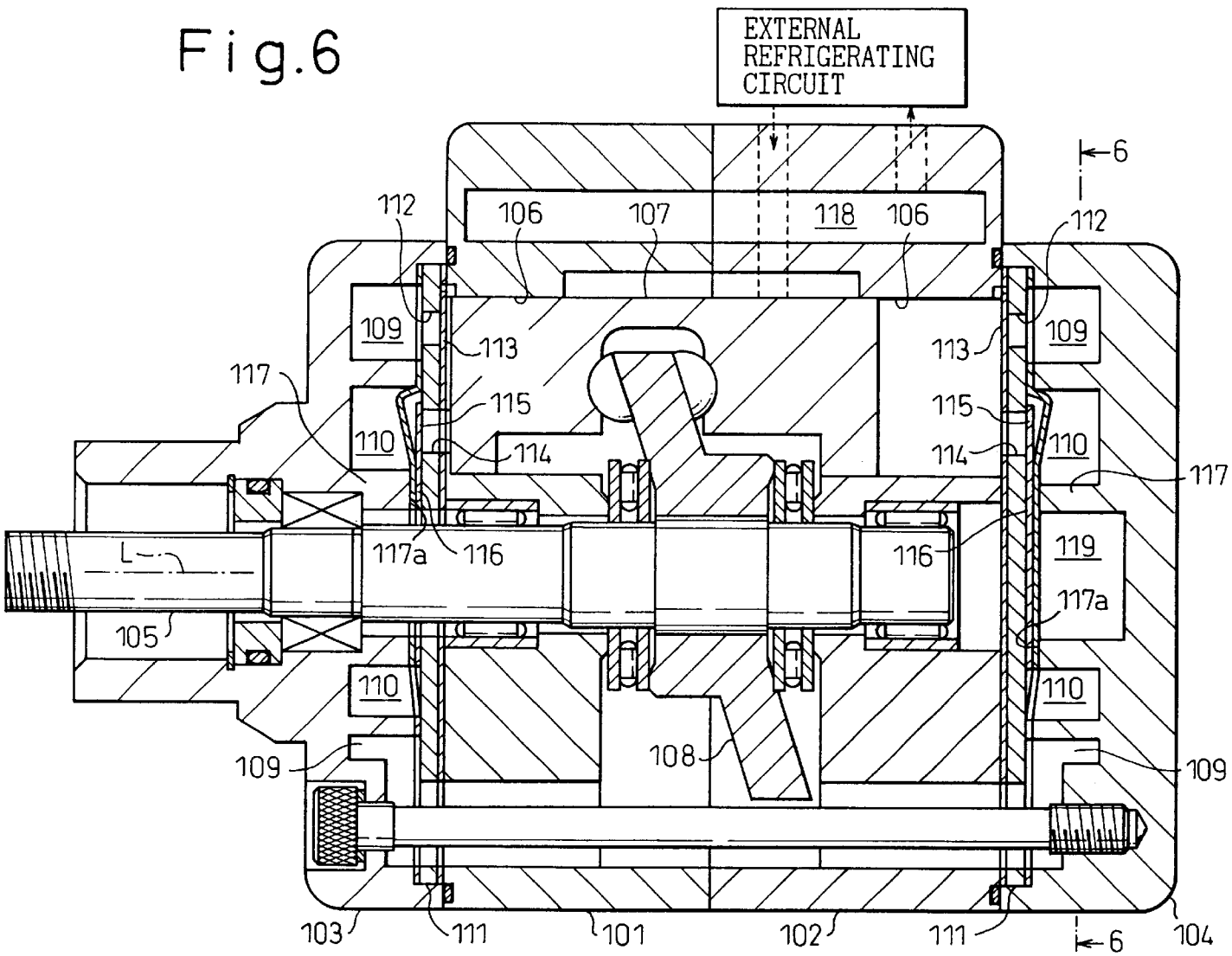
FIG. 6 is sectional view taken along a line 5—5 of FIG. 7 and is a longitudinal sectional view of a double head piston type compressor according to the prior art.
Figure 7:
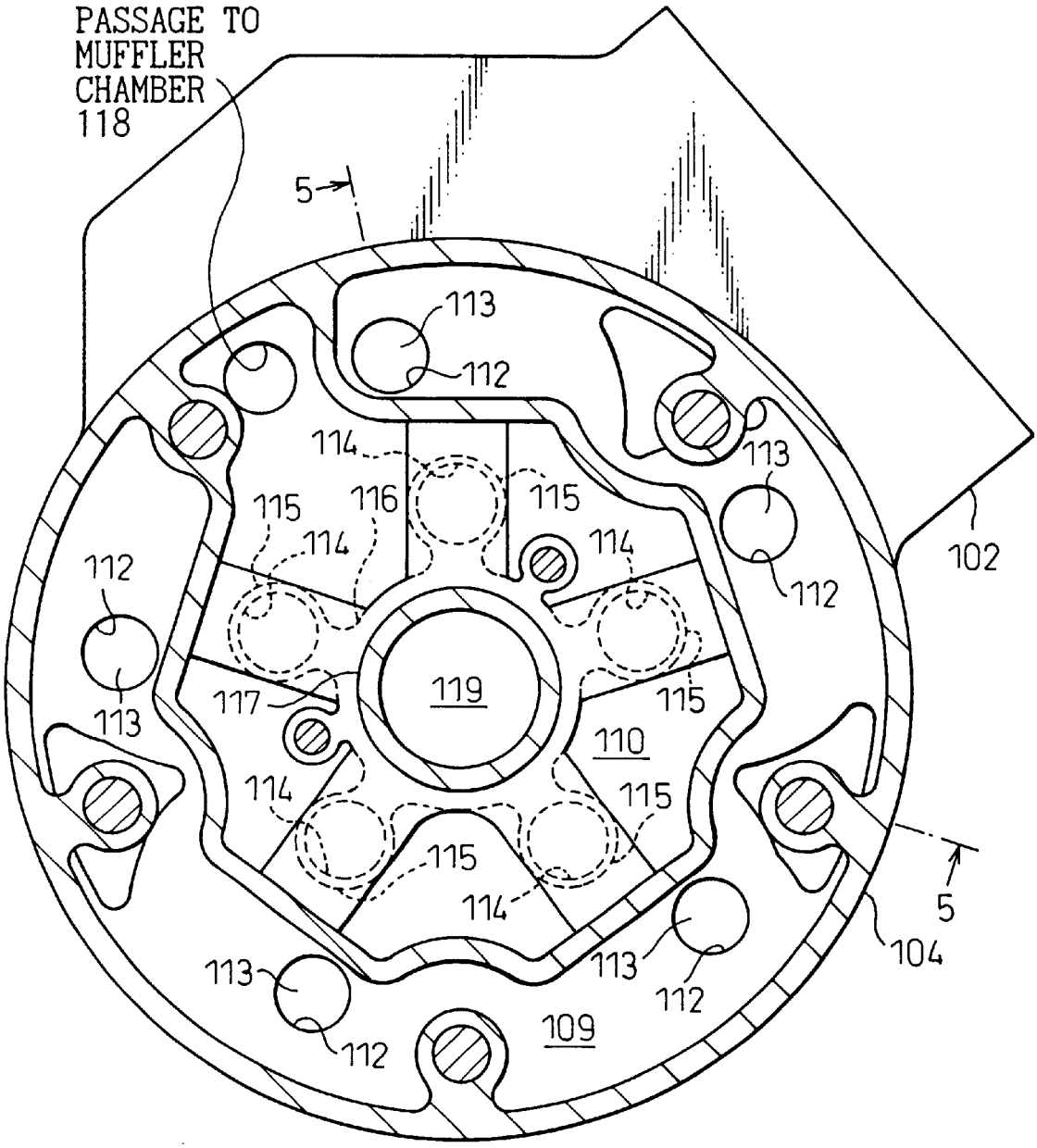
FIG. 7 is a sectional view taken along a line 6—6 of FIG. 6.

One of the reasons is because the flow of the discharge refrigerant gas from each discharge port 32*b* is rectified by the limitation of the flow in one direction. Another reason is because the discharge refrigerant gas from the discharge port 32*b* at the remotest position from the communication chamber 28 in the communication relation flows substantially one turn around the retaining portion 37. In the interim, the capacity of the discharge chamber 27 itself exhibits an effective muffler function. This also holds true of the discharge refrigerant gas from the discharge port 32*b* at the second remotest position from the communication chamber 28 in the communication relation. In this case, the discharge refrigerant gas flows about a half turn around the retaining portion 37. (In the compressor shown in FIGS. 6 and 7, the discharge refrigerant gas from the discharge port 114 at the remotest position flows about a half turn.)

The refrigerant gas discharged from each discharge port 32*b* on the rear side to the discharge chamber 27 flows into the main muffler chamber 24 through the communication hole 40, the center muffler chamber 39, the communication passage 41, the communication chamber 28 and then through the discharge passage 29. Pressure pulsations of the discharge refrigerant gas from the front side are reduced to a certain extent by the expansion type muffler operation by the center muffler chamber 39 before the discharge refrigerant gas flows into the main muffler space 24.

This embodiment provides the following effects.

(1) The internal space of the retaining portion of the rear housing is effectively utilized as the center muffler chamber 39. The center muffler chamber 39 exhibits a pre-muffler operation. Even when the main muffler chamber 24 does not have a large capacity (or the same capacity as that of the muffler chamber 118 of the compressor shown in FIGS. 6 and 7, for example), an effective muffler operation can be obtained, as a whole, in the same way as in a muffler chamber having a large capacity. In consequence, pressure pulsations of the discharge refrigerant gas can be reduced effectively without increasing the size of the muffler chamber.

(2) The partition wall 38 disposed in the front housing 13 limits the fluidizing direction of the discharge refrigerant gas inside the discharge chamber 27 on the front side to one direction. Therefore, because the discharge chamber 27 exhibits the pre-muffler function due to this limitation of the fluidizing direction to one direction, the main muffler chamber 24 the size of which is not so great and can exhibit a large overall muffler operation. Consequently, the effect of the item (1) can be further enhanced.

(3) The center muffler chamber 29 is defined inside the discharge chamber 27 as the retaining portion 37 functioning as the ring-like wall body comes into contact at its distal end face 37*a* with the valve/port-forming member 14 in its ring-like region. When the cylinder block 12 and the rear housing 15 are joined and fixed to each other, the internal space of the retaining portion 37 is closed by the valve/port-forming member 14 that functions also as the cover. Therefore, any cover dedicated to close this space is not necessary, and the production cost of the compressor can be reduced eventually.

The present invention can be worked in the following way, too, without departing from the scope thereof.

In the embodiment described above, three communication holes 40 are formed in the retaining portion 37 on the rear side. However, the number of communication holes 40 is not limited to three but may be changed to one, two, four or five.

Besides the double-headed piston-type compressor, the present invention can be applied also to a single-headed piston-type compressor.

While the present invention has thus been described by reference to specific embodiments thereof chosen for purposes of illustration, it should be apparent that numerous modifications could be made thereto by those skilled in the art without departing from the basic concept and scope of the invention.

What is claimed is:

1. A piston type compressor including:

a cylinder block;

a front housing joined and fixed to an end portion of said cylinder block;

a rear housing joined and fixed to other end portion of said cylinder block on the rear side;

a drive shaft so rotatably disposed as to extend from said cylinder block to said front housing;

a plurality of cylinder bores formed round said drive shaft in said cylinder block;

pistons each accommodated in said cylinder bore and driven for rotation by the revolution of said drive shaft;

a suction chamber defined inside and on the outer peripheral side of said rear housing;

a discharge chamber defined inside and on the inner peripheral side of said suction chamber;

valve/port-forming members each being clamped between said cylinder block and said rear housing, and equipped with a suction port and a suction valve each disposed between each of said cylinder bores and said suction chamber, and with a discharge port and a discharge valve each disposed between each of said cylinder bores and said discharge chamber; and a retaining portion so formed in said rear housing as to extend into said discharge chamber, and retaining said valve/port-forming member, by the distal end face thereof, in cooperation with said cylinder block;

wherein a center muffler chamber is defined inside said retaining portion; and wherein a discharge refrigerant gas from said discharge chamber flows to an external refrigerating circuit through said center muffler chamber.

2. A piston type compressor according to claim 1, wherein a main muffler chamber is defined at an outer profile portion of said cylinder block, and the discharge refrigerant gas from said center muffler chamber flows to said external circuit through said main muffler chamber.

3. A piston type compressor according to claim 1, wherein said cylinder block comprises a pair of cylinder blocks joined and fixed to each other at mutually opposing ends thereof, and said piston is of a double-headed type, and accommodated in said cylinder bore of each of said cylinder blocks;

said piston type compressor including:

a suction chamber defined inside said front housing on the outer peripheral side of said front housing;

a discharge chamber on the front side, defined inside said front housing on the inner peripheral side of said suction chamber;

a valve/port-forming member clamped between said cylinder block and said front housing, and equipped with a suction port and a suction valve each being disposed between each of said cylinder bores and said suction chamber on the front side, and with a discharge port and a discharge valve each disposed between each of said cylinder bores and said discharge chamber on the front side; and a retaining portion so formed in said front housing as to extend into said discharge chamber on the front side, retaining said valve/port-forming member on the front side by the distal end face thereof in cooperation with said cylinder block, and cutting-off said discharge chamber on the front side from said drive shaft;

said front housing having a partition wall for limiting the flow of the discharge refrigerant gas round said retaining portion to one direction, formed by partitioning off said discharge chamber on the front side.

4. A piston type compressor according to claim 2, wherein said cylinder block comprises a pair of cylinder blocks joined and fixed to each other at mutually opposed ends thereof, and said piston is of a double-headed type, and accommodated in said cylinder bore of each of said cylinder blocks;

said piston type compressor including:

a suction chamber defined inside said front housing on the outer peripheral side of said front housing;

a discharge chamber on the front side, defined inside said front housing on the inner peripheral side of said suction chamber;

a valve/port-forming member clamped between said cylinder block and said front housing, and equipped with a suction port and a suction valve each being disposed between each of said cylinder bores and said suction chamber on the front side, and with a discharge port and a discharge valve each disposed between each of said cylinder bores and said discharge chamber on the front sides; and a retaining portion so formed in said front housing as to extend into said discharge chamber on the front side, retaining said valve/port-forming member on the front side by the distal end face thereof in cooperation with said cylinder block, and cutting-off said discharge chamber on the front side from said drive shaft;

said front housing having a partition wall for limiting the flow of the discharge refrigerant gas round said retaining portion to one direction, formed by partitioning off said discharge chamber on the front side.

5. A piston type compressor according to claim 3, wherein the discharge gas from said discharge chamber on the front side flows to an external refrigerating circuit through said main muffler chamber.

6. A piston type compressor according to claim 4, wherein the discharge refrigerant gas from said discharge chamber on the front side flows to the external refrigerating circuit through said main muffler chamber.

7. A piston-type compressor according to claim 1, wherein said retaining portion comprises a wall body having a ring-like shape, and said valve/port-forming member is retained by said retaining portion in a ring-like region.

* * * * *